US009182697B2

(12) United States Patent
Kiyama et al.

(10) Patent No.: US 9,182,697 B2
(45) Date of Patent: Nov. 10, 2015

(54) METHOD OF PRINTING BY WET ELECTROPHOTOGRAPHY

(71) Applicant: MITSUBISHI PAPER MILLS LIMITED, Chiyoda-ku, Tokyo (JP)

(72) Inventors: Hideto Kiyama, Tokyo (JP); Hideaki Ishiguro, Tokyo (JP); Norimasa Miyachi, Tokyo (JP); Masahiro Kawasaki, Tokyo (JP); Takayuki Morikawa, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 266 days.

(21) Appl. No.: 13/931,209

(22) Filed: Jun. 28, 2013

(65) Prior Publication Data

US 2013/0287456 A1 Oct. 31, 2013

Related U.S. Application Data

(62) Division of application No. 13/176,989, filed on Jul. 6, 2011, now abandoned.

(30) Foreign Application Priority Data

| | | |
|---|---|---|
| Jul. 7, 2010 | (JP) | 2010-154730 |
| Dec. 7, 2010 | (JP) | 2010-272683 |
| Jan. 27, 2011 | (JP) | 2011-014743 |
| Jan. 27, 2011 | (JP) | 2011-015052 |
| Feb. 24, 2011 | (JP) | 2011-038735 |

(51) Int. Cl.

| | |
|---|---|
| ***G03G 13/14*** | (2006.01) |
| ***G03G 7/00*** | (2006.01) |
| ***B41M 5/52*** | (2006.01) |
| ***G03G 13/16*** | (2006.01) |

(52) U.S. Cl.

CPC ..... *G03G 13/14* (2013.01); *B41M 5/5218* (2013.01); *G03G 7/004* (2013.01); *G03G 7/0013* (2013.01); *G03G 7/0053* (2013.01); *G03G 7/0093* (2013.01); *G03G 13/16* (2013.01)

(58) Field of Classification Search

CPC ..... G03G 13/14; G03G 13/16; G03G 7/0093; B41M 5/5218

USPC ..... 430/125.6

See application file for complete search history.

(56) References Cited

U.S. PATENT DOCUMENTS

| | | | | |
|---|---|---|---|---|
| 6,492,005 | B1 | 12/2002 | Ohbayashi et al. | |
| 7,014,974 | B1 | 3/2006 | Almog et al. | |
| 2002/0136865 | A1 | 9/2002 | Ogino et al. | |
| 2007/0065606 | A1 * | 3/2007 | Tojo et al. | 428/32.3 |

FOREIGN PATENT DOCUMENTS

| | | | |
|---|---|---|---|
| JP | 9-114122 | A | 5/1997 |
| JP | 10-20537 | A | 1/1998 |
| JP | 2000-158808 | A | 6/2000 |
| JP | 2000-250246 | A | 9/2000 |
| JP | 2000-263928 | A | 9/2000 |
| JP | 2003-510639 | A | 3/2003 |
| JP | 2003-173038 | A | 6/2003 |
| JP | 2004-503805 | A | 2/2004 |
| JP | 2004-77667 | A | 3/2004 |
| JP | 2004-258339 | A | 9/2004 |
| JP | 2004-276419 | A | 10/2004 |
| JP | 2005-17844 | A | 1/2005 |
| JP | 2005-96284 | A | 4/2005 |
| JP | 2005-250168 | A | 9/2005 |
| JP | 2006-39435 | A | 2/2006 |
| JP | 2008-7899 | A | 1/2008 |
| JP | 2008-81719 | A | 4/2008 |
| JP | 2008-238755 | A | 10/2008 |
| JP | 2009-7571 | A | 1/2009 |
| JP | 2009-169408 | A | 7/2009 |
| JP | 2010-6978 | A | 1/2010 |
| JP | 2010-58492 | A | 3/2010 |
| JP | 2010-94987 | A | 4/2010 |
| JP | 2010-228418 | A | 10/2010 |
| JP | 2013-136526 | A | 7/2013 |
| WO | WO 02/05036 | A1 | 1/2002 |
| WO | WO 2004/049074 | A1 | 6/2004 |
| WO | WO 2006/035761 | A1 | 4/2006 |

* cited by examiner

*Primary Examiner* — Mark A Chapman

(74) *Attorney, Agent, or Firm* — Birch Stewart Kolasch & Birch, LLP

(57) ABSTRACT

Recording sheet for wet electrophotography, having excellent toner fixability and transferability when printing is carried out by using a wet electrophotographic system employing a wet toner. The recording sheet for wet electrophotography is a recording sheet to be used in a wet electrophotographic system wherein an image is transferred from a heated blanket roll to a recording sheet. The recording sheet comprises a substrate and a toner receiving layer provided thereon containing inorganic fine particles and having a pore volume with a pore radius of 100 nanometers or less measured by a nitrogen adsorption method of 0.3 mL/g or more.

16 Claims, No Drawings

METHOD OF PRINTING BY WET ELECTROPHOTOGRAPHY

The present application is a 37 C.F.R. §1.53 (b) divisional of, and claim priority to, U.S. application Ser. No. 13/716,989, filed Jul. 6, 2011, now abandoned. Priorty is also claimed to Japanese Application No. 2010-154730 filed Jul. 7, 2010, Japanese Application No. 2010-272683 filed Dec. 7, 2010, Japanese Application No. 2011-014743 filed Jan. 27, 2011, Japanese Application No. 2011-015052 filed Jan. 27, 2011 and Japanese Application No. 2011-038735 filed Feb. 27, 2011. The entire contents of each of these applications is hereby incorporated by reference.

TECHNICAL FIELD

The present invention relates to a recording sheet for electrophotography in which printing is carried out by using a wet electrophotographic system.

BACKGROUND ART

Printing using an electrophotographic system has been markedly developed in recent years not only in a printer for PC (personal computer), facsimile or copying machine, but also in the so-called on-demand printing field which realizes printing with many kinds of products and a small lot size, variable information printing, etc. In recent years, accompanying with improvement in printing speed and image quality, it is now started to utilize the system in the region in which a large number of printing is carried out as in the conventional offset printing or gravure printing.

The electrophotographic printing is a printing system not using a printing plate so that it has a merit that variable information can be treated. On the other hand, offset printing or gravure printing cannot treat variable information, but are suitable for high quality printing with inexpensive and a large amount. Thus, in the electrophotographic system, for opposing to the offset printing or gravure printing, technical development has been carried out in the points of a printing machine, toner and recording sheet to obtain high image quality, high speed printing, saving electric power, and low cost. Also, there are demands to further improve toner fixability, transferability, color reproducibility, etc.

Among electrophotographic printing systems, a dry electrophotographic system is a system represented by a copying machine for official use, etc., and as a toner for forming an image, a solid powder toner comprising a pigment and a synthetic resin is used. Printing is carried out by an image forming method which comprises adsorbing a toner to an electrostatic image formed on a light-sensitive material, transferring the toner to a material to be transferred, and heating the material to be transferred to fix the toner thereon. However, when the toner is made fine for the purpose of high quality image in this system, the toner is likely dissipated to surroundings, whereby there are problems in health when the toner is inhaled by a person and further a printed material is contaminated. Due to the limitation of making the toner fine, there are pointed out the problems that fine dot printing cannot be carried out, a consumed amount of the toner is large, an image is swelled and looks unnatural as a printed material, etc. In addition, there are problems that a recording sheet becomes waving due to high temperature fixing, and a consumed electric power becomes large. As a recording sheet to be used in the dry electrophotographic system, other than usual paper, there are recording sheets in which a porous toner receiving layer is provided on a substrate as disclosed in JP S63-33749A, JP H7-81214A, JP 2006-227473A, JP 2007-127767A, JP 2007-240826A, JP 2008-70422A, etc.

On the other hand, the wet electrophotographic system is an extremely promising system. This is because the toner is dispersed in a liquid medium in the wet electrophotographic system, so that no problem in dissipation of powder occurs, a size of the toner can be made fine about 1/10 as compared with that of the dry electrophotographic system, i.e., fine dot printing can be carried out, no problem occurs in weather resistance since a pigment can be used as a coloring agent, swelling of an image is not so significant whereby the quality of the printed material is close to that of the offset printing, etc.

In an image forming method of the wet electrophotographic system, a wet toner is adsorbed onto an electrostatic image formed on a light-sensitive material, a solvent contained in the wet toner is removed prior to transfer the image on a recording sheet, and then the toner is transferred onto the recording sheet to form an image. Or else, after transferring a toner containing a solvent onto a recording sheet, the solvent contained in the toner is removed to form an image. When the solvent in the wet toner is to be removed prior to transfer onto the recording sheet, a blanket roll heated to about 60 to 120° C. is utilized. In this case, a wet toner image containing a solvent on a light-sensitive material is firstly transferred onto a blanket roll, and the solvent is removed by the heat of the blanket roll. Next, the toner is heat-fused on the blanket roll to have stickiness and transferred onto a recording sheet to form an image. On the other hand, when the solvent in the wet toner is to be removed after transferring onto a recording sheet, the recording sheet on which the wet toner containing the solvent has transferred is heated to remove the solvent on the recording sheet, and the toner is heat-fused thereon to fix it to the same.

In the method in which an image is transferred from a heated blanket roll to a recording sheet, it is not necessary to directly heat the recording sheet, so that heat resistance of the recording sheet is irrelevant to form an image. Thus, a film or a substrate for photographic printing with low heat resistance can be used as a substrate for the recording sheet, so that it is preferred to broaden the width of choices of the recording sheet.

In the method in which an image is transferred from a heated blanket roll to a recording sheet, no adsorption action due to static electricity is utilized when an image is transferred onto the recording sheet. Transfer of the image of this case is carried out so that an adhesiveness of the wet toner and the recording sheet is higher than that of the wet toner and the blanket roll. That is, for transferring the toner onto the recording sheet effectively, a transferability of the wet toner from the blanket roll to the recording sheet is important. When an adhesive ability of the toner itself is heightened than required for the purpose of heightening adhesiveness between the recording sheet and the toner, fixing to the sheet becomes good. However, adhesiveness between the blanket roll and the toner is also heightened simultaneously whereby the toner becomes difficultly peeling from the blanket roll so that the adhesive ability of the toner cannot be heightened than required. Thus, in the case of a wet electrophotographic system printing in which an image is transferred from the heated blanket roll to the recording sheet, there are defects that sufficient toner fixing strength cannot be obtained when printing is carried out, or toner particles are not sufficiently transferred onto the sheet. If sufficient toner fixing strength cannot be obtained, the image on the printed material is markedly deteriorated by handling thereafter. Also, if transfer of the toner is not sufficient and incomplete, a part of the toner remains on the blanket roll surface, and it appears in an image printing thereafter as a remaining image (ghost) to markedly lower the image quality. Occurrence of such a ghost also occurs, for example, when continuous printing is carried out, by the reason that the blanket roll surface is suffered from bad effects at a non-image portion at which the blanket roll surface and the recording sheet are directly contacted, and wet toner transferability of an image to be printed later is lowered and ghost occurs in some cases.

Thus, as a means to obtain a sufficient toner fixing strength, there is a method in which a fixing agent is coated onto a recording sheet. For example, a wet electrophotographic printing machine manufactured by Hewlett Packard has a treatment function called "Sapphire treatment", which is to cover the recording sheet with polyethyleneimine, but there are problems that yellowing occurs during storage of the recording sheet, or toner is peeled off when the printed material is handled after printing. Also, to provide wet electrophotographic printing suitability without employing such a treatment, it has been known a recording sheet as disclosed in, for example, JP H10-20537A (Patent Literature 1), JP 2003-173038A (Patent Literature 2), and JP 2004-503805A (Patent Literature 3), etc., in which a coating layer containing a polyamide series polymer having an amino group as the terminal group or a poly-ethyleneimine series polymer had been provided on a substrate. However, it is extremely difficult to obtain sufficient toner fixability or transferability.

As a means to improve fixability of the wet toner or transferability of the toner on a blanket roll surface without using a fixing agent, there have been proposed a method in which calcium carbonate or kaolin which easily absorbs a solvent contained in the wet toner is added to a toner receiving layer of a recording sheet as disclosed in, for example, JP 2004-77667A (Patent Literature 4), JP 2005-250168A (Patent Literature 5), WO 2004/49074A (Patent Literature 6), JP 2009-169408A (Patent Literature 7), etc. These methods act as a method for improving toner fixability but are not sufficient, so that further improvement has been desired. Also, an example in which a toner receiving layer is constituted by a polyvinyl alcohol is disclosed in JP 2005-17844A (Patent Literature 8), an example in which it is constituted by a polyvinyl alcohol and colloidal silica is disclosed in JP H9-114122A (Patent Literature 9), and an example in which it is constituted by various kinds of latex resins is disclosed in JP 2006-39435A (Patent Literature 10), JP 2004-258339A (Patent Literature 11), etc. However, even when these toner receiving layers are employed, there is a sense of incongruity (gloss unevenness) in glossy feeling between an image portion and a non-image portion, whereby it is not reached to a sufficient level as photographic image quality.

Also, various kinds of copolymer latexes such as styrene-butadiene series, acrylic series, polyvinyl acetate, ethylene-vinyl acetate, etc., and various kinds of starches, which are used as a binder in the toner receiving layer containing a pigment of the recording sheet for the wet electrophotographic system, do not necessarily have a high binding force with the pigment, so that there are problems that peeling, causing crack or crack by folding of the toner receiving layer occurs depending on the kind of the pigment or an added amount thereof. In particular, when inorganic fine particles having a small particle size are used as a pigment, the above-mentioned problem becomes more remarkable.

PRIOR ART LITERATURE

Patent Literatures

[Patent Literature 1] JP H10-20537A
[Patent Literature 2] JP 2003-173038A
[Patent Literature 3] JP 2004-503805A
[Patent Literature 4] JP 2004-77667A
[Patent Literature 5] JP 2005-250168A
[Patent Literature 6] WO/JP2004/049074A
[Patent Literature 7] JP 2009-169408A
[Patent Literature 8] JP 2005-17844A
[Patent Literature 9] JP H9-114122A
[Patent Literature 10] JP 2006-39435A
[Patent Literature 11] JP 2004-258339A

SUMMARY OF THE INVENTION

Problems to be Solved by the Invention

An object of the present invention is to provide a recording sheet for wet electrophotography having excellent toner fixability and transferability, when printing is carried out by using a wet electrophotographic system which employs a wet toner. It is also an object to provide a recording sheet for wet electrophotography having excellent toner fixability and transferability which prevent occurrence of structural color even when a dry coated amount of the toner receiving layer is a little. Further object is to provide a recording sheet for electrophotography having excellent continuous printability by restraining occurrence of ghost even when continuous printing is carried out, to provide a recording sheet for wet electrophotography having excellent photographic image quality by reducing gloss unevenness between an image portion and a non-image portion, and to provide a recording sheet for wet electrophotography excellent in preventing cracking by folding.

Means to Solve the Problems

The above-mentioned problems have basically solved by a recording sheet for wet electrophotography which is a recording sheet to be used in a wet electrophotographic system in which an image is transferred from a heated blanket roll to a recording sheet, which comprises a substrate and a toner receiving layer formed thereon, containing inorganic fine particles and having a pore volume with a pore radius of 100 nm or less measured by a nitrogen adsorption method of 0.3 mL/g or more.

Said toner receiving layer preferably comprises at least two layers of toner receiving layers comprising an inorganic fine particle layer containing inorganic fine particles, and an uppermost layer containing cationic colloidal silica provided on said inorganic fine particle layer.

Said toner receiving layer preferably contains a pearl gloss pigment.

Said toner receiving layer preferably contains a modified polyvinyl alcohol having a keto group and a cross-linking agent thereof.

Said pore volume is preferably 0.7 mL/g or more, further preferably 0.9 mL/g or more.

A dry coated amount of said toner receiving layer is preferably 0.1 to 2 g/m$^2$, and an arithmetical mean roughness Ra regulated by KS B0601-1982 of a toner receptive layer-coated surface on said substrate is preferably 0.5 μm or more.

An average secondary particle diameter of said inorganic fine particles is preferably 500 nm or less.

A content of the inorganic fine particles in said toner receiving layer is preferably 50% by weight or more, more preferably 70% by weight or more based on the whole solid component of the toner receiving layer.

Effects of the Invention

According to the present invention, when printing is carried out by using a wet electrophotographic system which employs a wet toner, a recording sheet for wet electrophotography having excellent toner fixability and transferability can be provided. Also, even when a dry coated amount of a toner receiving layer is a little, a recording sheet for wet electrophotography in which occurrence of a structural color can be prevented and which has excellent toner fixability and transferability can be provided. Moreover, it is possible to provide a recording sheet for electrophotography which can restrain occurrence of ghost even when continuous printing is carried out, and having excellent continuous printability, to provide a recording sheet for wet electrophotography which is reduced in gloss unevenness between an image portion and a non-image portion, and having excellent photographic image quality, and to provide a recording sheet for wet electrophotography excellent in preventing from crack by folding.

EMBODIMENTS TO CARRY OUT THE INVENTION

In the following, the recording sheet for wet electrophotography of the present invention is explained in detail.

<Substrate>

As a base material to be possessed by the recording sheet for wet electrophotography of the present invention, there may be mentioned a water-absorbable base material such as paper, uncoated paper, art paper, coated paper, cast-coated paper, etc., or a non-water-absorbable base material such as a resin-coated paper in which at least one surface of the base paper is coated with a resin and a resin film, etc. Of these, the non-water-absorbable base material is preferred since its surface smoothness is high so that adhesiveness between the blanket roller and the recording sheet is heightened to give excellent toner transferability. A polyolefin resin-coated paper on which a polyolefin resin layer is coated onto at least one surface of the base paper has higher elasticity as compared with a resin film since it has a base paper, and the surface thereof is smooth, whereby it is more preferred since higher toner transferability can be obtained. A thickness of these substrates is preferably 50 to 300 μm, more preferably those having 80 to 260 μm are used.

The polyolefin resin-coated paper to be preferably used in the present invention is described in more detail. A water content of the polyolefin resin-coated paper to be used in the present invention is not particularly limited, and in view of preventing curling, it is preferably in the range of 5.0 to 9.0% by weight, more preferably in the range of 6.0 to 9.0% by weight. The water content of the polyolefin resin-coated paper can be measured by using an optional water-content measurement method. For example, there may be used an infrared moisture meter, bone-dry weight measurement method, permittivity measurement method, Karl Fischer's method, etc.

The base paper which constitutes the polyolefin resin-coated paper is not particularly limited, and paper generally used may be used, and more preferably, for example, smooth raw paper such as those used as a substrate for photographic printing. As a pulp to constitute the base paper, there may be used natural pulp, regenerated pulp, synthetic pulp, etc., alone or in combination of two or more kinds. To the base paper are formulated an additive generally be used in paper-making such as a sizing agent, a strengthening additive of paper, a filler, an antistatic agent, a fluorescent brightener, a dye, etc.

Moreover, a surface sizing agent, a surface strengthening additive of paper, fluorescent brightener, antistatic agent, dye, an anchoring agent, etc., may be coated on the surface of the base paper.

A thickness of the base paper is not particularly limited, and those having good surface smoothness obtained by applying a pressure during preparing a paper or after paper-making, by a calendar, etc., and compressed are preferred, and the basis weight is preferably 30 to 250 g/m$^2$.

As the polyolefin resin for coating the base paper, there may be used a homopolymer of an olefin such as a low-density polyethylene, high-density polyethylene, polypropylene, polybutene, polypentene, etc., or a copolymer comprising two or more olefins such as an ethylene-propylene copolymer, etc., and a mixture thereof and those having various kinds of densities, Melt Viscosity Index (melt index) may be used alone or in admixture thereof.

To the resin of the polyolefin resin-coated paper, white color pigments such as titanium dioxide, zinc oxide, talc, calcium carbonate, etc.; aliphatic acid amides such as stearic acid amide, arachidic acid amide, etc., aliphatic acid metal salts such as zinc stearate, calcium stearate, aluminum stearate, magnesium stearate, etc.; antioxidants such as a hindered phenol type compound, etc.; blue pigments or dyes such as Cobalt Blue, ultramarine blue, Cecilian Blue, Phthalocyanine Blue, etc.; magenta pigments or dyes such as Cobalt Violet, Fast Violet, Manganese Purple, etc.; various kinds of additives such as a fluorescent brightener, UV absorber, etc., may be added in optional combination.

For preparing the polyolefin resin-coated paper, it can be prepared by the method in which a resin is heat-fused by an extruder, the resin is extruded between a base paper and a cooling roller in a film state, adhered under pressing, and cooling. Depending on the shape of the surface of the cooling roller, surface shape of the resin layer can be formed. To the surface of the resin-coated paper, high glossiness, non-glossiness or patterned embossing, for example, silk state or matte state embossing can be carried out. Before coating the resin on the base paper, it is preferred to apply an activating treatment on the base paper such as a corona discharge treatment, flame treatment, etc. A thickness of the resin-coated layer is suitable 5 to 50 μm.

For applying embossing to the surface of the resin layer of the polyolefin resin-coated paper, it is possible by a method in which after these various kinds of resins are film molded, at least one surface of the resin film is subjected to embossing due to the means such as cast to a embossing roll, and laminated to at least one surface of the base paper.

At the side of the substrate on which the toner receiving layer is provided to be used in the present invention, a subbing layer is preferably provided. The subbing layer is previously coated on the surface of the substrate before providing the toner receiving layer by coating. The subbing layer mainly comprises a film-formable water-soluble polymer or polymer latex, etc. It is preferably a water-soluble polymer such as gelatin, polyvinyl alcohol, polyvinyl pyrrolidone, water-soluble cellulose, etc., particularly preferably gelatin. An attached amount of these water-soluble polymers is preferably 10 to 500 mg/m$^2$, more preferably 20 to 300 mg/m$^2$. Further, other surfactant(s) or film-hardening agent(s) is/are preferably added to the subbing layer. By providing the subbing layer on the substrate, it effectively act on preventing crack at the time of coating the toner receiving layer, and a uniform coating surface can be obtained.

On the opposite surface of the surface of the substrate on which the toner receiving layer is provided, various kinds of backing layer(s) may be provided for the purpose of preventing curl, preventing sticking due to overlapping immediately after printing or further improving toner transferability.

<Toner Receiving Layer>

The toner receiving layer to be possessed by the recording sheet of the present invention is characterized in that it contains inorganic fine particles, and a pore volume with a pore radius of 100 nm or less measured by the nitrogen adsorption method thereof is 0.3 mL/g or more. Further, it is preferred to contain inorganic fine particles having an average secondary particle diameter of 500 nm or less as said inorganic fine particles. By using such fine inorganic fine particles, surface smoothness of the recording sheet becomes high whereby excellent toner transferability can be obtained.

A content of the inorganic fine particles in the toner receiving layer according to the present invention is preferably 50% by weight or more, more preferably 70% by weight or more based on the whole solid content of the toner receiving layer. Such a toner receiving layer having high content of the inorganic fine particles becomes a porous toner receiving layer with a large pore volume.

The inorganic fine particles to be used in the toner receiving layer according to the present invention may be mentioned conventionally known various kinds of fine particles such as amorphous synthetic silica, alumina, alumina hydrate, calcium carbonate, magnesium carbonate, titanium dioxide, etc., and in the point of giving larger pore volume, amorphous synthetic silica, alumina or alumina hydrate is preferably used. As the amorphous synthetic silica, fumed silica and wet process silica mentioned below are preferably used in the viewpoints of fixability and transferability of the toner.

The amorphous synthesized silica can be roughly classified into wet process silica, fumed silica, and others according to the preparation processes. The wet process silica can be further classified into a precipitation method silica, a gel method silica and a sol method silica according to the preparation processes. The precipitation method silica can be prepared by reacting sodium silicate and sulfuric acid under alkali conditions, silica particles grown in particle size aggregated and precipitated, and then, they are processed through filtration, washing, drying, pulverization and classification to prepare a final product. As the precipitation method silica, it is commercially available from TOSOH SILICA CORPORATION (Japan) under trade name of Nipsil, and K.K. Tokuyama (Japan) under trade name of Tokusil. The gel method silica can be produced by reacting sodium silicate and sulfuric acid under acidic conditions. In this method, small silica particles are dissolved during ripening and so reprecipitated between other primary particles which are larger sized particles that primary particles are combined to each other. Thus, clear primary particles are disappeared and relatively hard aggregated particles having internal void structure are formed. The gel method silica is commercially available, for example, from TOSOH SILICA CORPORATION (Japan) under trade name of Nipgel, and Grace Japan Co., Ltd. (Japan) under trade names of SYLOID and SYLOJET. The sol method silica is also called as colloidal silica and can be obtained by heating and ripening silica sol obtained by metathesis of sodium silicate by an acid, etc., or passing through an ion-exchange resin layer, and is commercially available, for example, from Nissan Chemical Industries, Ltd. (Japan) under trade name of SNOWTEX.

Fumed silica is called as drying method silica contrary to the wet type silica, and can be generally prepared by a flame hydrolysis method. More specifically, it has been known a method in which silicon tetrachloride is burned with hydrogen and oxygen. In this method, silanes such as methyl trichlorosilane, trichlorosilane, etc., may be used alone in place of silicon tetrachloride or in combination with silicone tetrachloride. The fumed silica is commercially available from Nippon Aerosil K.K. (Japan) under the trade name of Aerosil, and K.K. Tokuyama (Japan) under the trade name of QS type, etc.

In the present invention, finned silica can be preferably used. An average primary particle diameter of the fumed silica to be used in the present invention is preferably 30 nm or less. More preferred are those having an average primary particle diameter of 3 to 15 nm and a specific surface area measured by the BET method of 200 $m^2/g$ or more, particularly preferred are those having an average primary particle diameter of 3 to 10 nm and a specific surface area measured by the BET method of 250 to 500 $m^2/g$. The average primary particle diameter mentioned in the present invention is an average particle diameter obtained from an observation of fine particles by an electron microscope, and for each of 100 primary particles existing in a predetermined area, a diameter of a circle whose area is equivalent to a projected area of each particle is taken as a particle diameter for that particle. The BET method mentioned in the present invention means one of methods for measuring a surface area of powder material by a gas phase adsorption method and is a method of obtaining a total surface area possessed by 1 g of a sample, i.e., a specific surface area, from an adsorption isotherm. As an adsorption gas, a nitrogen gas has generally and frequently been used, and a method of measuring an adsorption amount obtained by the change in pressure or a volume of a gas to be adsorbed has most frequently been used. Most frequently used equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

The fumed silica may be dispersed in the presence of either of the compounds of cationic or anionic. An average secondary particle diameter of the fumed silica is preferably 5 μm or less, more preferably 500 nm or less, particularly preferably 10 to 300 nm. As a dispersing method, it is preferred that the fumed silica and a dispersing medium are provisionally mixed with usual propeller stirring, turbine type stirring, homomixer type stirring, etc., then, dispersing treatment is carried out by using media mills such as a ball mill, a beads mill, a sand grinder, etc., pressure type dispersing machines such as a high pressure homogenizer, a ultra-high pressure homogenizer, etc., a ultrasonic wave dispersing machine, and a thin film spin system disperser, etc. Incidentally, an average secondary particle diameter referred to in the present invention can be obtained by taking a photograph with a transmission type electron microscope, and as a simple and easy method, it can be measured by using a laser scattering type particle size distribution analyzer (for example, LA920, manufactured by HORIBA, Ltd.), and measuring a median diameter per number of particles.

In the present invention, wet process silica can be preferably used. As the wet process silica herein used, precipitated silica or gel method silica is preferably used, and precipitated silica is particularly preferred. The wet process silica particles to be used in the present invention are preferably those which are finely pulverized having an average primary particle diameter of 50 nm or less, more preferably 3 to 40 μm, and an average secondary particle diameter of preferably 5 μm or less, more preferably 500 nm or less, particularly preferably 20 to 200 nm or so.

The wet process silica may be dispersed and pulverized in the presence of either a cationic or anionic compound. As the pulverization method, a wet dispersing method in which silica dispersed in an aqueous medium is mechanically pulverized can be preferably used. As a preferred method for pulverizing wet process silica fine particles to be used in the present invention, a method for dispersing it in the presence of a cationic compound is explained as an example. First, silica particles and a cationic compound are mixed in a dispersing medium mainly comprising water, and dispersed by using at least dispersing device such as a saw blade type dispersing device, a propeller blade type dispersing device, and a rotor stator type dispersing device to obtain a silica provisional dispersion. If necessary, a suitable amount of a low boiling point solvent, etc., may be further added to the aqueous dispersing medium. A concentration of the solid content of the silica provisional dispersion is preferably as high as possible, but if it is too high concentration, dispersing operation is impossible, so that the solid concentration is preferably in the range of 15 to 40% by weight, more preferably 20 to 35% by weight. Next, wet process silica dispersion can be obtained by applying silica provisional dispersion to a mechanical means having a more potent shearing force to pulverize the silica particles. As the mechanical means, those conventionally known in the art can be employed, and there may be used, for example, media mills such as a ball mill, beads mill, sand grinder, etc., pressure type dispersing devices such as a high-pressure homogenizer, ultra high-pressure homogenizer, etc., an ultrasonic wave dispersing device, and a thin-film spin type dispersing device, etc.

As the cationic compound to be used for dispersing the above-mentioned fumed silica and wet process silica, a cationic polymer can be preferably used. As the cationic polymer, a polyethyleneimine, polydiallylamine, polyallylamine, alkylamine polymerized product, a polymer having a primary to tertiary amino group, a polymer having a quaternary ammonium salt group, etc., can be preferably used. In particular, diallylamine derivatives are preferably used as the cationic polymer. A weight average molecular weight of these cationic polymers is preferably 2,000 to 100,000, and more preferably 2,000 to 30,000 in view of dispersibility and dispersion viscosity.

As the alumina to be used in the present invention, γ-alumina which is a γ type crystal of the aluminum oxide is preferred, and of these, 8 group crystal is preferred. As the γ-alumina, there may be used those having an average secondary particle diameter of preferably 5 μm or less, more preferably 500 nm or less, particularly preferably 20 to 300 nm or so in which secondary particles crystals generally having a size of several thousands to several ten thousands nm are pulverized by using an ultrasonic wave, a high pressure homogenizer, a counter-collision type jet pulverizer, etc.

The alumina hydrate to be used in the present invention is represented by the structural formula: $Al_2O_3.nH_2O$ (n=1 to 3). The alumina hydrate to be used in the present invention can be obtained by the conventionally known preparation methods such as hydrolysis of aluminum alkoxide including aluminum isopropoxide, etc., neutralization of an aluminum salt with an alkali, hydrolysis of an aluminate, etc. An average secondary particle diameter of the alumina hydrate to be used in the present invention is preferably 5 μm or less, more preferably 500 nm or less, and particularly preferably 20 to 300 nm.

The above-mentioned alumina and alumina hydrate to be used in the present invention may be dispersed in the presence of either of the cationic or anionic compound. As the cationic compound, the conventionally known dispersants such as acetic acid, lactic acid, formic acid, nitric acid, etc., can be preferably used.

Among the above-mentioned inorganic fine particles, 2 or more kinds of the inorganic fine particles may be used in combination. There may be mentioned, for example, a combination of finely pulverized wet process silica and fumed silica, a combination of finely pulverized wet process silica and alumina or alumina hydrate, and a combination of fumed silica and alumina or alumina hydrate.

The recording sheet of the present invention preferably contains a pearl gloss pigment in addition to the above-mentioned inorganic fine particles in the toner receiving layer. According to this, gloss unevenness between an image portion to which the toner has been transferred and a non-image portion to which no toner has been transferred can be improved. Gloss unevenness is caused by the differences in glossiness between the image portion and the non-image portion or glossy feeling such as image clarity. Glossy feeling at the image portion is determined by transfer of the toner, and glossy feeling at the image portion becomes generally low. If the glossiness of the recording sheet is previously matched to that of the image portion, it is possible to reduce gloss unevenness, but in such a case, glossy feeling of the recording sheet becomes low so that good photographic image quality cannot be obtained. However, by containing a pearl gloss pigment in the toner receiving layer, the gloss unevenness can be reduced without lowering glossiness the non-image portion.

In the pearl gloss pigment to be used in the present invention, there may be mentioned a natural product such as fish scale foil and natural mica, and a synthetic product such as a material in which the surface of basic lead carbonate, bismuth oxychloride or natural mica is covered by a metal oxide, and a material in which the surface of synthetic mica is covered by a metal oxide. Of these, those in which the surface of natural mica is covered by a metal oxide, or the surface of synthetic mica is covered by a metal oxide is preferably used in the points of easily obtained and safety. The pearl gloss pigment is preferably in a fiat plate state. Here, the flat plate state means an aspect ratio (average particle diameter/average particle thickness) of the pearl gloss pigment of 5 or more, and more preferred pearl gloss pigment has an average particle thickness of 0.2 to 0.9 μm, an average particle diameter of 1 to 200 μm, and an aspect ratio of 5 to 200. Such a pearl gloss pigment may be mentioned titanium dioxide-coated mica, iron oxide-coated mica, titanium dioxide-coated alumina oxide flake, bismuth oxychloride, etc., and they are commercially available, for example, from Merck Co., & Inc. under the trade names of Iriodin 100, Iriodin 103, Iriodin 111, Iriodin 123 and Xirallic T50-10 Crystal Silver, from NIHONKOKEN Co., Ltd. (Japan) under the trade name of ME-100R, MF-100R, MM-100R, MB-100R as PEARL-GLAZE series, and other manufacturers with the same objects whereby various kinds of different grades can be easily obtained.

In the present invention, an added amount of the pearl gloss pigment in the toner receiving layer is preferably in the range of 3 to 50% by weight based on the total solid content of the toner receiving layer. If it is less than 3% by weight, there is a case where the objective effect could not sufficiently be obtained, while if it is larger than 50% by weight, there is a case where dispersibility is insufficient and stability during production lacks. An amount of the pearl gloss pigment to be added is more preferably in the range of 5 to 35% by weight.

In the present invention, in the toner receiving layer, a binder is preferably contained in combination with inorganic fine particles and the pearl gloss pigment. The binder to be used may be mentioned, for example, a polyvinyl alcohol, gelatin, polyethylene oxide, polyvinyl pyrrolidone, polyacrylic acid, polyacrylamide, polyurethane, dextran, dextrin, carrageenan (κ, ι, λ, etc.), agar, pullulan, chitosan derivatives, casein, soybean protein, water-soluble polyvinylbutyral, hydroxyethyl cellulose, carboxymethyl cellulose, etc. These binders may be used two or more kinds in combination. When the binder is used, it is preferred to not clog voids by swelling the binder by humidity during the preservation, and in this point of view, a binder having a relatively low swelling property is preferably used. Preferably used binder may include a completely or partially saponified polyvinyl alcohol or a cation-modified polyvinyl alcohol. Also, various kinds of emulsion or latex may be used as the binder.

Among the polyvinyl alcohols, particularly preferred are partially or completely saponified materials having a saponification degree of 80% or more. An average polymerization degree is preferably 200 to 5000.

As the cation-modified polyvinyl alcohol, those having either of a primary to tertiary amino groups or a quaternary ammonium group at the main chain or side chain of the polyvinyl alcohol are preferred.

In the present invention, a film-hardening agent may be used, if necessary, in addition of the above-mentioned binder which constitutes the toner receiving layer. Specific examples of the film-hardening agents may be mentioned aldehyde series compounds such as formaldehyde, glutaraldehyde, etc.; ketone compounds such as diacetyl, chloropentanedione, etc.; compounds having reactive halogen such as bis(2-chloroethyl)urea, 2-hydroxy-4,6-dichloro-1,3,5-triazine, etc.; compounds having reactive olefin such as divinylsulfone, etc.; N-methylol compounds; isocyanates; aziridine compounds; carbodiimide series compounds; epoxy compounds; halogen carboxyaldehydes such as mucochloric acid, etc.; dioxane derivatives such as dihydroxydioxane, etc.; inorganic cross-linking agents such as chromium alum, zirconium sulfate, borax, boric acid, borate, etc., and they may be used alone or in combination of two or more kinds thereof.

When a polyvinyl alcohol which is a partially or completely saponified with a saponification degree of 80% or more is used as a binder, borax, boric acid and/or borates is/are preferred, and boric acid is more preferred.

As the binder for constituting the toner receiving layer, a binder having a keto group may be preferably used. The binder having a keto group can be synthesized by a method in which a monomer having a keto group and other monomer are copolymerized, a method in which a keto group is introduced by a polymerization reaction, and the like. In particular, a modified polyvinyl alcohol having a keto group is preferred. As the modified polyvinyl alcohol having a keto group, an acetacetyl-modified polyvinyl alcohol, a diacetone acrylamide-modified polyvinyl alcohol, etc., may be mentioned.

The acetacetyl-modified polyvinyl alcohol can be synthesized by a conventionally known method such as a reaction of a polyvinyl alcohol and a diketene, etc. An acetoacetylation degree of the above polyvinyl alcohol is preferably 0.1 to 20 mol %, and more preferably 1 to 15 mol %. A saponification degree of the same is preferably 80 mol % or more, and more preferably 85 mol % or more. A polymerization degree of the same is preferably 500 to 5000, and more preferably 2000 to 4500.

The diacetone acrylamide-modified polyvinyl alcohol can be synthesized by a conventionally known method such as saponification of a diacetone acrylamide-vinyl acetate copolymer, etc. A content of the diacetone acrylamide unit is preferably in the range of 0.1 to 15 mol %, and more preferably in the range of 0.5 to 10 mol %. A saponification degree thereof is preferably 85 mol % or more, and a polymerization degree of the same is preferably 500 to 5000. It is also possible to use a completely or partially saponified polyvinyl alcohol or a cation-modified polyvinyl alcohol in combination with the binder having a keto group. In this case, a ratio of the binder having a keto group based on the total binder amount is preferably 30% by weight or more, more preferably 50% by weight or more.

In the present invention, the binder having a keto group contained in the toner receiving layer is preferably cross-linked by a cross-linking agent. Such a cross-linking agent may be mentioned a compound such as aliphatic polyamines, alicyclic polyamines, heterocyclic polyamines, aromatic polyamines, polyamide polyamines, polyether polyamines, dicyandiamide derivatives, hydrazine compounds, polyhydrazide compounds, aldehydes, methylol compounds, activated vinyl compounds, epoxy compounds, polyvalent metal salts, etc. Of these, polyhydrazide compounds and polyvalent metal salts are preferred. Also, the binder having a keto group other than the acetacetyl-modified portion or the diacetone acrylamide-modified portion has the same structure as that of the usual polyvinyl alcohol, so that the above-mentioned film-hardening agent can be used in combination. In particular, when the above mentioned cross-linking agent is used, it is preferred to use borax, boric acid and/or borate in combination A content of the binder in the toner receiving layer according to the present invention is preferably in the range of 1 to 50% by weight based on the whole solid content of the toner receiving layer, and more preferably 5 to 40% by weight for forming a porous layer since pores are formed in the toner receiving layer.

A dry coated amount of the toner receiving layer according to the present invention is preferably in the range of 0.1 to 50 $g/m^2$, more preferably in the range of 0.3 to 40 $g/m^2$, and particularly preferably in the range of 0.5 to 35 $g/m^2$.

If the dry coated amount of the toner receiving layer in the present invention is a little as 0.1 to 2 $g/m^2$, structural color is confirmed in the recording sheet, whereby printing quality is sometimes impaired when an image is printed. In such a case, by making an arithmetical mean roughness Ra of the toner receptive layer-coated surface of the above-mentioned substrate 0.5 μm or more, occurrence of the structural color can be controlled. The structural color is a general term of a coloring phenomenon derived from a microstructure as fine as the light wavelength or a microstructure finer than the light wavelength such as light scattering, diffraction, etc., due to thin film interference, multi-layer interference, refractive index dissipation, fine particle structure, etc.

The arithmetical mean roughness Ra in the present invention can be analyzed by, for example, a surface roughness analyzing device SURFCOM 1400D manufactured by TOKYO SEIMITSU CO., LTD. Ra in the present invention means, in a portion extracted from an extraction curve with a standard length to the direction of an average line, an average deviation in which an area surrounded by the extraction curve and the average line is divided by the standard length, and is defined by JIS B0601-1982 (Japanese Industrial Standards).

The toner receiving layer according to the present invention is a porous toner receiving layer which is characterized in that it has a pore volume with a pore radius of 100 nm or less measured by the nitrogen adsorption method of 0.3 mL/g or more. More preferred pore volume is 0.7 mL/g or more, and further preferably 0.9 mL/g or more. The solvent is removed at the heated blanket roller, and the toner which becomes viscous is immediately absorbed by the pores, so that excellent toner transferability can be obtained. In the pores of the porous layer, a large amount of air at a room temperature exists, the viscous toner by heating is immediately cooled to give excellent toner fixability, and no bleed occurs in the toner so that high quality image can be obtained. The pore volume can be obtained by, for example, the BJH method which assumes pores as cylindrical shape pore model and from the nitrogen adsorption isotherm measured by using a specific surface area•pore distribution measurement device (SA3100 manufactured by Beckmann-Coulter).

The whole pore volume of the above-mentioned toner receiving layer can be calculated as the product of the above-mentioned pore volume and a dry coated amount of the toner receiving layer. For example, when the pore volume of the toner receiving layer with a dry coated amount of 25 $g/m^2$ is 1 mL/g, then, the whole pore volume of the toner receiving layer is 25 $mL/m^2$.

The toner receiving layer of the present invention may be constituted by two layers or more, and in this case, the constitutions of these image-receptive layers may be the same or different from each other. A preferred constitution of the toner receiving layer of the present invention is a constitution comprising at least two layers in which on a layer containing the above-mentioned inorganic fine particles, an uppermost layer mainly containing cationic colloidal silica as inorganic fine particles is further provided.

The uppermost layer preferably provided in the present invention mainly contains cationic colloidal silica. Here, the terms "mainly contains" mean that the cationic colloidal silica is contained in the uppermost layer in an amount of 50% by weight or more based on the solid content of the coated amount, more preferably 60% by weight or more.

The cationic colloidal silica means those in which a surface of the colloidal silica is modified by a cationic polymer, water-soluble polyvalent metal compound, cationic silane coupling agent, etc., or those a surface of which shows cationic property by introducing a cationic group into the particles surface during the preparation process of the colloidal silica. Of these, in the points of fixability with the wet toner and coating stability of the uppermost layer, cationic colloidal silica in which the colloidal silica surface is modified by a water-soluble polyvalent metal compound is preferred.

As the above-mentioned cationic polymer to be used for obtaining cationic colloidal silica, there may be preferably used a polyethyleneimine, polydiallylamine, polyallylamine, alkylamine polymerized product, polymer having a primary to tertiary amino group, polymer having a quaternary ammonium salt group, etc. A weight average molecular weight of these cation polymers is preferably 1000 to 100,000.

As the water-soluble polyvalent metal compound to be used for obtaining cationic colloidal silica, there may be mentioned, as a water-soluble polyvalent metal salt, a water-soluble salt of a metal selected from calcium, barium, manganese, copper, cobalt, nickel, aluminum, iron, zinc, zirconium, chromium, magnesium, tungsten and molybdenum. More specifically, there may be mentioned, for example, calcium acetate, calcium chloride, calcium formate, calcium sulfate, barium acetate, barium phosphate, manganese chloride, manganese acetate, manganese formate dihydrate, manganese ammonium sulfate hexahydrate, cupric chloride, copper(II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidesulfate tetrahydrate, nickel phenolsulfonate, aluminum sulfate, aluminum sulfite, aluminum thiosulfate, polyaluminum chloride, basic polyaluminum hydroxide, aluminum sulfate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, zinc phenolsulfonate, zirconium acetate, zirconium chloride, zirconium oxychloride octahydrate, zirconium hydroxyl chloride, chromium acetate, magnesium sulfate, magnesium chloride hexahydrate, magnesium citrate nonahydrate, sodium phosphortungstate, tungsten sodium citrate, dodecamolybdatephosphate n hydrate, etc. Of these, there is a material having a pH of unsuitably low. In such a case, the pH may be optionally adjusted and then used. In the present invention, the term water-soluble means that a material is dissolved in water at a normal temperature and a normal pressure in an amount of 1% by weight or more as a general measure. In the present invention, a water-soluble metal salt comprising zirconium and aluminum is preferred. As the water-soluble metal salt comprising zirconium, they are commercially available, for example, from DAIICHI KIGENSO KAGAKU KOGYO CO., LTD. (Japan) under the trade name of ZA-30. As the water-soluble metal comprising aluminum, they are commercially available, for example, from Taki Chemical, K.K (Japan) under the trade name of poly(aluminum chloride) (PAC) as a water treatment agent, from Asada Chemical K.K (Japan) under the trade name of poly(aluminum hydroxide) (Paho), from K.K. Riken Green (Japan) under the trade name of Pyurakemu WT and other manufacturers with the same objects whereby various kinds of different grades can be easily obtained.

A solid content mixing ratio (colloidal silica, part(s) by weight/cationic agent, part(s) by weight) of the cationic agent (cationic polymer, water-soluble polyvalent metal compound) which modifies colloidal silica is preferably 100/2 to 100/20, more preferably 100/5 to 100/15.

Cationization of the colloidal silica by the treatment using a cationic silane coupling agent can be carried out by adding an amino group-containing silane coupling agent to anionic colloidal silica. Specific treatment method may be mentioned, for example, a method in which colloidal silica is heated preferably to 40 to 95° C., more preferably 70° C. or so, and a cationic silane coupling agent is continuously added thereto dropwise, a method in which colloidal silica and a cationic silane coupling agent are charged at a room temperature and mixed, and then, reacted them by heating to the above-mentioned temperature, a method in which a cationic silane coupling agent and a catalyst are simultaneously added to the colloidal silica dropwise, a method in which a cationic silane coupling agent dissolved in a solvent is supplied in such a state to a reaction system containing colloidal silica, and a method in which a cationic silane coupling agent emulsified by an emulsifying agent is supplied in such a state to a reaction system containing colloidal silica.

As the cationic silane coupling agent which can be used to obtain a cationic silane coupling agent-treated colloidal silica, there may be preferably utilized an amino group-containing silane coupling agent. The silane coupling agent may be mentioned, for example, N-(β-aminoethyl)-γ-aminopropylmethyldimethoxy silane, N-(β-aminoethyl)-γ-aminopropyltrimethoxy silane, N-(β-aminoethyl)-γ-aminopropyltriethoxy silane, γ-aminopropyltrimethoxy silane, γ-aminopropyltriethoxy silane, etc.

A solid content mixing ratio of the cationic silane coupling agent (colloidal silica, part(s) by weight/cationic silane coupling agent, parks) by weight) where a colloidal silica is treated by a cationic silane coupling agent is preferably 100/0.01 to 100/20, more preferably 100/0.05 to 100/10.

The colloidal silica to be used in the present invention may be used, for example, those in which anionic colloidal silica commercially available such as SNOWTEX ST-20, ST-30, ST-40, ST-C, ST-N, ST-20L, ST-O, ST-OL, ST-S, ST-XS, ST-XL, ST-YL, ST-ZL, ST-OZL, etc., available from Nissan Chemical Industries, Ltd., and Quartron PL series (trade name) available from Fuso Chemical Co., Ltd., etc., are cationized by the above-mentioned cationic agent. Also, commercially available cationic colloidal silica in which it has already been cationized by a water-soluble polyvalent metal compound such as aluminum, etc., can be used and there may be mentioned, for example, SNOWTEX ST-AK-L, ST-UP-AK, ST-AK, ST-PS-M-AK, ST-AK-YL, etc., available from Nissan Chemical Industries, Ltd.

An average primary particle size of the colloidal silica to be used in the uppermost layer of the present invention is preferably 5 to 100 nm, and more preferably 30 to 60 nm to obtain good toner fixability and transferability.

A coating amount as a solid content of the cationic colloidal silica contained in the uppermost layer is preferably 0.05 to 5 g/m$^2$, and more preferably in the range of 0.5 to 3 g/m$^2$ to obtain excellent wet toner fixability, excellent wet toner transferability and restraining occurrence of ghost.

The present inventors have found that by employing a constitution wherein an uppermost layer mainly comprising cationic colloidal silica is laminated on the layer containing the above-mentioned inorganic fine particles, a recording sheet having good fixability of the wet toner, inhibiting occurrence of ghost even when continuous printing is carried out, and having excellent continuous printability can be obtained. The ghost in the present invention means a phenomenon that a blanket roll surface is suffered from a bad effect at a non-image portion at which the blanket roll surface and the recording sheet are directly contacted when continuous printing is carried out, and transferability of the toner on the blanket roll surface after continuous printing becomes ununiform like the image after continuous printing is carried out, whereby a remaining image generates in a printing image to be printed thereafter. As the surface of the blanket roll to be used in a wet electrophotographic system in which an image is transferred from the heated blanket roll to the recording sheet, those constituted by a thin layer such as a silicone rubber and a silicone series resin, etc., have been known, and a part of the solvent of the wet toner is considered to be absorbed by the surface. When the surface of the blanket roll and the surface of the recording sheet are directly contacted repeatedly at the time of continuous printing, the surface of the blanket roll sometimes deteriorated, and in such a state, absorption of the solvent at the surface of the blanket roll becomes ununiform which affects to transfer of the toner to the recording sheet, whereby ghost is considered to be generated. In the recording sheet of the present invention, in addition to excellent toner transferability due to presence of the porous toner receiving layer, and further, by mainly containing cationic colloidal silica in the uppermost layer of the toner receiving layer, it can be considered to realize the recording sheet which can maintain excellent toner transferability and fixability, and can effectively inhibit deterioration of the surface of the non-image portion of the blanket roll when continuous printing is carried out whereby occurrence of ghost to the later printed image can be effectively restrained.

A content of the binder in the uppermost layer of the present invention is preferably in the range of 0 to 40% by weight based on the whole solid content of the uppermost layer, and more preferably 0 to 20% by weight to form a porous layer by forming pores in the uppermost layer.

To the toner receiving layer of the present invention, a cationic polymer, an antiseptic agent, a surfactant, a coloring dye, a coloring pigment, a UV absorber, an antioxidant, a dispersant of the pigment, a defoaming agent, a leveling agent, a fluorescent brightener, a viscosity stabilizer, a pH adjusting agent, etc., may be further added.

As a coating system which can be used for coating the toner receiving layer of the present invention, various kinds of conventionally known coating systems can be used. There may be mentioned, for example, spray gun system, slide bead system, slide curtain system, extrusion system, slot die system, gravure roll system, air knife system, blade coating system, rod bar coating system, etc.

EXAMPLES

In the following, the present invention is explained in detail by referring to Examples, but the content of the present invention is not limited by Examples. Incidentally, part(s) and % represent part(s) by weight and % by weight, respectively.

<Preparation of Recording Sheet 1>

[Preparation of Substrate 1]

A mixture of a bleached kraft pulp of hardwood (LBKP) and a bleached sulfite pulp of hardwood (LBSP) with a weight ratio of 1:1 was subjected to beating until it becomes 300 ml by the Canadian Standard Freeness to prepare a pulp slurry. To the slurry were added alkyl ketene dimer in an amount of 0.5% based on the amount of the pulp as a sizing agent, polyacrylamide in an amount of 1.0% based on the same as a strengthening additive of paper, cationic starch in an amount of 2.0% based on the same, and a polyamide epichlorohydrin resin in an amount of 0.5% based on the same, and the mixture was diluted with water to prepare a slurry with a solid content concentration of 0.2%. This slurry was made paper by a tourdrinier paper machine to have a basis weight of 170 g/m$^2$, dried and subjected to moisture conditioning to prepare a base paper for a polyolefin resin-coated paper. A polyethylene resin composition comprising a low density polyethylene resin having a density of 0.918 g/cm$^3$ and anatase type titanium dioxide in an amount of 10% based on the amount of the polyethylene which had been dispersed uniformly in the resin was melted at 320° C. and the melted resin composition was subjected to extrusion coating on a surface of the above-mentioned base paper with a thickness of 35 μm and subjected to extrusion coating by using a cooling roller subjected to slightly roughening treatment to make a toner receiving layer-coating surface. An arithmetical mean roughness Ra of the resulting toner receiving layer-coating surface was measured by using a surface roughness analyzing device (SURFCOM 1400D manufactured by Tokyo Seimitsu Co., Ltd.) and it was 0.12 μm. On the other surface of the base paper, a blended resin composition comprising 70 parts of a high density polyethylene resin having a density of 0.962 g/cm$^3$ and 30 parts of a low density polyethylene resin having a density of 0.918 g/cm$^3$ melted similarly at 320° C. was subjected to extrusion coating with a thickness of 30 μm and subjected to extrusion coating by using a cooling roller subjected to roughening treatment to make a back surface whereby a polyolefin resin-coated paper of Substrate 1 was prepared.

[Subbing Layer]

High frequency corona discharge treatment was applied to the toner receiving layer-coating surface of Substrate 1, and then, a subbing layer with the following composition was coated so that a dry coated amount of gelatin became 50 mg/m$^2$, and dried.

| | |
|---|---|
| Lime-treated gelatin | 100 parts |
| 2-Ethylhexyl sulfosuccinate | 2 parts |
| Chrome alum | 10 parts |

[Preparation of Toner Receiving Layer]

On the subbing layer of Substrate 1, a toner receiving layer coating solution 1 having the following composition was coated by using a slide bead coating device so that a dry coated amount became 25 g/m$^2$. After coating, the material was cooled at 10° C. for 20 seconds, and then, dried by blowing hot air of 30 to 55° C. When a pore volume of the pore radius of 100 nm or less in the obtained toner receiving layer was measured by using a specific surface area•pore distribution measurement device (SM3100 manufactured by Beckmann-Coulter), it was 1.0 mL/g.

[Preparation of Inorganic Fine Particles Dispersion 1]

To water were added 4 parts of dimethyl diallyl ammonium chloride homopolymer (a weight average molecular weight: 9,000) and 100 parts of fumed silica (average primary particle diameter: 7 nm, specific surface area: 300 m$^2$/g), a provisional dispersion was prepared. Then, the dispersion was treated by a high pressure homogenizer to carry out dispersing treatment, Inorganic fine particles dispersion 1 with a solid content concentration of 20% was prepared. When an average secondary particle diameter of the inorganic fine particles in the resulting dispersion was measured by using a particle size distribution analyzer (LA920 manufactured by Horiba Ltd.), it was 130 nm.

[Toner Receiving Layer Coating Solution 1]

| | |
|---|---|
| Inorganic fine particles dispersion 1 (as a solid content of the inorganic fine particles) | 100 parts |
| Polyvinyl alcohol (saponification degree: 88%, average polymerization degree: 3500) | 21 parts |
| Boric acid | 4 parts |

The mixture was adjusted with water so as to have a solid concentration of 12%. An amount of the inorganic fine particles based on the whole solid content is 80%.

<Preparation of Recording Sheet 2>

In the same manner as in Recording sheet 1 except for changing the toner receiving layer coating solution 1 of the above-mentioned Recording sheet 1 to the toner receiving layer coating solution 2 having the following composition, Recording sheet 2 was prepared. A pore volume with a pore radius of 100 nm or less of the obtained toner receiving layer was 0.5 mL/g.

[Toner Receiving Layer Coating Solution 2]

| | |
|---|---|
| Inorganic fine particles dispersion 1 (as a solid content of the inorganic fine particles) | 100 parts |
| Polyvinyl alcohol (saponification degree: 88%, average polymerization degree: 3500) | 62 parts |
| Boric acid | 4 parts |

The mixture was adjusted with water so as to have a solid concentration of 12%. An amount of the inorganic fine particles based on the whole solid content is 60%.

<Preparation of Recording Sheet 3>

In the same manner as in Recording sheet 1 except for changing the toner receiving layer coating solution 1 of the above-mentioned Recording sheet 1 to the toner receiving layer coating solution 3 having the following composition, Recording sheet 3 was prepared. A pore volume with a pore radius of 100 nm or less of the obtained toner receiving layer was 0.1 mL/g.

[Toner Receiving Layer Coating Solution 3]

| | |
|---|---|
| Inorganic fine particles dispersion 1 (as a solid content of the inorganic fine particles) | 100 parts |
| Polyvinyl alcohol (saponification degree: 88%, average polymerization degree: 3500) | 146 parts |
| Boric acid | 4 parts |

The mixture was adjusted with water so as to have a solid concentration of 12%. An amount of the inorganic fine particles based on the whole solid content is 40%.

<Preparation of Recording Sheet 4>

In the same manner as in Recording sheet 1 except for changing the toner receiving layer coating solution 1 of the above-mentioned Recording sheet 1 to the toner receiving layer coating solution 4 having the following composition, Recording sheet 4 was prepared. A pore volume with a pore radius of 100 nm or less of the obtained toner receiving layer was 0 mL/g.

[Toner Receiving Layer Coating Solution 4]

| | |
|---|---|
| Polyvinyl alcohol (saponification degree: 88%, average polymerization degree: 3500) | 100 parts |

The mixture was adjusted with water so as to have a solid concentration of 12%. An amount of the inorganic fine particles based on the whole solid content is 0%.

<Preparation of Recording Sheet 5>

In the same manner as in Recording sheet 1 except for changing the toner receiving layer coating solution 1 of the above-mentioned Recording sheet 1 to the toner receiving layer coating solution 5 having the following composition, Recording sheet 5 was prepared. A pore volume with a pore radius of 100 nm or less of the obtained toner receiving layer was 1.2 mL/g.

[Inorganic Fine Particles Dispersion 2]

To water were added 4 parts of dimethyl diallyl ammonium chloride homopolymer (a weight average molecular weight: 9,000) and 100 parts of precipitated silica (oil absorption amount: 200 mL/100 g, average primary particle diameter 16 nm, average secondary particle diameter: 9 μm), and by using a saw blade type dispersing device (blade peripheral speed: 30 m/sec), a provisional dispersion was prepared. Next, the resulting provisional dispersion was treated by bead mill to obtain Inorganic fine particles dispersion 2 with a solid content concentration of 30%. An average secondary particle diameter of the inorganic fine particles of the obtained dispersion was 200 nm.

[Toner Receiving Layer Coating Solution 5]

| | |
|---|---|
| Inorganic fine particles dispersion 2 (as a solid content of the inorganic fine particles) | 100 parts |
| Polyvinyl alcohol (saponification degree: 88%, average polymerization degree: 3500) | 21 parts |
| Boric acid | 4 parts |

The mixture was adjusted with water so as to have a solid concentration of 12%. An amount of the inorganic fine particles based on the whole solid content is 80%.

<Preparation of Recording Sheet 6>

In the same manner as in Recording sheet 1 except for changing the toner receiving layer coating solution 1 of the above-mentioned Recording sheet 1 to the toner receiving layer coating solution 6 having the following composition, Recording sheet 6 was prepared. A pore volume with a pore radius of 100 nm or less of the obtained toner receiving layer was 1.4 mL/g.

[Preparation of Inorganic Fine Particles Dispersion 3]

To water were added 4 parts of dimethyl diallyl ammonium chloride homopolymer (weight average molecular weight: 9,000) and 100 parts of fumed silica (average primary particle diameter: 7 nm, specific surface area: 300 $m^2/g$) to prepare a provisional dispersion, and the dispersion was treated by a high pressure homogenizer to prepare Inorganic fine particles dispersion 3 with a solid content concentration of 20%. An average secondary particle diameter of the inorganic fine particles of the obtained dispersion was 800 nm.

[Toner Receiving Layer Coating Solution 6]

| | |
|---|---|
| Inorganic fine particles dispersion 3 (as a solid content of the inorganic fine particles) | 100 parts |
| Polyvinyl alcohol (saponification degree: 88%, average polymerization degree: 3500) | 21 parts |
| Boric acid | 4 parts |

The mixture was adjusted with water so as to have a solid concentration of 12%. An amount of the inorganic fine particles based on the whole solid content is 80%.

<Preparation of Recording Sheet 7>

In the same manner as in Recording sheet 1 except for changing the toner receiving layer coating solution 1 of the above-mentioned Recording sheet 1 to the toner receiving layer coating solution 7 having the following composition, Recording sheet 7 was prepared. A pore volume with a pore radius of 100 nm or less of the obtained toner receiving layer was 0.8 mL/g.

[Preparation of Inorganic Fine Particles Dispersion 4]

To water were added nitric acid (2.5 parts) and alumina hydrate (pseudoboehmite, primary particle diameter: 14 nm), and by using a saw blade type dispersing device, Inorganic fine particles dispersion 4 with a solid content concentration of 30% was prepared. An average secondary particle diameter of the inorganic fine particles of the obtained dispersion was 160 nm.

[Toner Receiving Layer Coating Solution 7]

| | |
|---|---|
| Inorganic fine particles dispersion 4 (as a solid content of the inorganic fine particles) | 100 parts |
| Polyvinyl alcohol (saponification degree: 88%, average polymerization degree: 3500) | 10 parts |
| Boric acid | 0.6 parts |

The mixture was adjusted with water so as to have a solid concentration of 12%. An amount of the inorganic fine particles based on the whole solid content is 90%.

<Preparation of Recording Sheet 8>

In the same manner as in Recording sheet 1 except for changing the toner receiving layer coating solution 1 of the above-mentioned Recording sheet 1 to the toner receiving layer coating solution 8 mentioned below, Recording sheet 8 was prepared. A pore volume with a pore radius of 100 nm or less of the obtained toner receiving layer was 0.6 mL/g.

[Inorganic Fine Particles Dispersion 5]

To water were added 4 parts of dimethyl diallyl ammonium chloride homopolymer (weight average molecular weight: 9,000) and 100 parts of precipitated silica (oil absorption amount: 200 mL/100 g, average primary particle diameter: 16 nm, average secondary particle diameter: 9 μm), and by using a saw blade type dispersing device (blade peripheral speed: 30 m/sec), a provisional dispersion was prepared. Next, the resulting provisional dispersion was treated by bead mill to obtain Inorganic fine particles dispersion 5 with a solid content concentration of 30%. An average secondary particle diameter of the inorganic fine particles of the obtained dispersion was 2000 nm.

[Toner Receiving Layer Coating Solution 8]

| | |
|---|---|
| Inorganic fine particles dispersion 5 (as a solid content of the inorganic fine particles) | 100 parts |
| Acrylic resin emulsion (as a resin solid content) | 150 parts |

The mixture was adjusted with water so as to have a solid concentration of 12%. An amount of the inorganic fine particles based on the whole solid content is 40%.

<Preparation of Recording Sheet 9>

On the base paper having a basis weight of 170 $g/m^2$ which is the same as that used for preparing Substrate 1 used in the above-mentioned Recording sheet 1, in accordance with Example of JP 2009-169408A, the toner receiving layer coating solution 9 having the following composition was coated so that a dry coated amount of 14 $g/m^2$ in one surface and 28 $g/m^2$ in both surfaces by using a blade coater and dried. Thereafter, soft calendar treatment comprising a metal roll and an elastomeric roll was applied so that the metal roll is contacted each once with the front and back surfaces to obtain Recording sheet 9. The calendar line pressure was made 80 kN/m. A pore volume with a pore radius of 100 nm or less of the obtained toner receiving layer was 0.2 mL/g.

[Toner Receiving Layer Coating Solution 9]

| | |
|---|---|
| Heavy calcium carbonate (average secondary particle diameter: 350 nm) | 100 parts |
| Commercially available styrene-butadiene latex binder (as a resin solid content) | 11 parts |
| Commercially available phosphated starch | 2 parts |
| Commercially available calcium stearate lubricant | 0.6 part |
| Commercially available carboxymethyl cellulose thickening agent (CMC) | 0.1 part |

The mixture was adjusted with sodium hydroxide so as to have a pH 9.6.

<Preparation of Recording Sheet 10>

In the same manner as in Recording sheet 1 except for changing a dry coated amount of the toner receiving layer coating solution of Recording sheet 1 to 1 $g/m^2$, Recording sheet 10 was prepared. A pore volume with a pore radius of 100 nm or less of the obtained toner receiving layer was 1.0 mL/g.

<Preparation of Recording Sheet 11>

In the same manner as in Recording sheet 10 except for changing Substrate 1 of Recording sheet 10 to Substrate 2 mentioned below, Recording sheet 11 was prepared. A pore volume with a pore radius of 100 nm or less of the obtained toner receiving layer was 1.0 mL/g.

[Preparation of Substrate 2]

In the same manner as in Substrate 1 except for using a cooling roller the subjected to surface roughening treatment in place of the cooling roller subjected to slightly surface roughening treatment in the formation of a resin layer of the toner receiving layer-coating surface, Substrate 2 was prepared. An arithmetical mean roughness Ra of the obtained toner receiving layer coated surface was 0.87 μm.

<Evaluation>

Recording sheets 1 to 11 were evaluated by the following mentioned evaluation methods, and the results are shown in Table 1.

[Fixability: Tape Peeling Test]

By using "E-print 1000" manufactured by Indigo as a wet electrophotographic printing machine for transferring an image from a heated blanket roll to a recording sheet, fixability of wet toner was evaluated. By using solid images in which each of four colors: black, cyan, magenta and yellow, and multi-colored image in which four colors were overlapped, as printing images, these images were each printed on a recording sheet. With regard to the solid printed portions of the printed respective colors, tape peeling test was carried out. The tape peeling test was carried out by adhering a cellophane adhesive tape with a width of 18 mm to the printed portion of the respective colors without unevenness, and the tape was slowly peeled at 180° peeling with a rate of about 5 mm/sec. Fixed degree of the toner to the sheet after peeling was judged with naked eyes, and the evaluation was carried out by the following criteria. The tape peeling test was carried out under the four conditions of immediately after printing, after 1 hour, after 4 hours, and after 1 day. "X" means it has a problem for practical use.

◎: No toner peeled off in all colors.

○: Almost part of the toner remained on the sheet with respective colors.

Δ: The toner was peeled off from the sheet in part of the colors, to cause white portions in the printed portion.

X: The toner was peeled off from the sheet in all colors, and white portions in the printed portion are significant.

[Transferability]

Printing was carried out by using E-PRINT 1000 with regard to respective recording sheets, then, cleaning of the blanket roll was carried out by using a print cleaner, and depending on a degree of stain of the print cleaner, transferability was judged by the following criteria. "X" means it has a problem for practical use.

○: No stain.

Δ: Slight stain attached.

X: Stained.

[Structural Color]

When the recording sheet was observed with naked eyes, whether structural color could be admitted or not was judged by the following criteria. "X" means it has a problem for practical use.

○: No structural color was admitted.

Δ: Structural color was slightly admitted.

X: Structural color was admitted.

As is clear from the above-mentioned results, according to the present invention, a recording sheet for wet electrophotography having excellent toner fixability and transferability can be obtained. Even when a dry coated amount of the toner receiving layer is not so much, a recording sheet for wet electrophotography having excellent toner fixability and transferability can be obtained without causing structural color.

<Preparation of Recording Sheet 12>

On the toner receiving layer of Recording sheet 1, an uppermost layer coating solution 1 having the following composition was coated by a gravure coating device so that a dry solid content of the colloidal silica became 0.1 g/m$^2$, and dried at 50° C. to prepare a toner receiving layer of Recording sheet 12. A pore volume with a pore radius of 100 nm or less of the obtained toner receiving layer was 1.0 mL/g.

[Uppermost Layer Coating Solution 1]

To water was added 100 parts of Quartron PL-3L (colloidal silica; solid content concentration: 20% by weight, available from Fuso Chemical Co., Ltd.) to prepare a liquid with a solid content concentration of 5% by weight, and to the mixture was added 10 parts of Takibine #1500 (polyaluminum chloride aqueous solution; solid content concentration: 23.5% by weight, available from Taki Chemical Co., Ltd.) over about 10 minutes under stirring to obtain cationic colloidal silica. After completion of the addition, the mixture was stirred at a temperature of 80° C. for 1 hour, then, cooled to room temperature, and adjusted with water so that the solid content concentration became 0.6% by weight. When the dried material of the coating solution was observed by an electron microscope, an average primary particle size of the cationic colloidal silica was 35 nm.

<Preparation of Recording Sheet 13>

On the subbing layer of Substrate 1 which is the same as that used in Recording sheet 1 were coated the toner receiving layer coating solution 1 used in Recording sheet 1 and the following uppermost layer coating solution 2 by simultaneous multi-layer coating by using a slide bead coating device so that a dry coated amount of the toner receiving layer coating solution 1 became 25 g/m$^2$, and a dry solid coated amount of the colloidal silica in the uppermost layer coating solution 2 became 2.0 g/m$^2$. After coating, it was cooled at 10° C. for 20 seconds, and then, hot air of 30 to 55° C. was blown to the same to carry out drying to obtain a toner receiv-

TABLE 1

| Recording sheet No. | Tape peeling test: Immediately after | After 1 hour | After 4 hours | After 1 day | Transferability | Structural color | Remarks |
|---|---|---|---|---|---|---|---|
| 1 | ○ | ◎ | ◎ | ◎ | ○ | ○ | Example |
| 2 | ○ | ○ | ○ | ◎ | Δ | ○ | Example |
| 3 | X | X | Δ | ○ | X | ○ | Comparative example |
| 4 | X | X | Δ | ○ | X | ○ | Comparative example |
| 5 | ○ | ◎ | ◎ | ◎ | ○ | ○ | Example |
| 6 | ○ | ◎ | ◎ | ◎ | ○ | ○ | Example |
| 7 | ○ | ○ | ◎ | ◎ | ○ | ○ | Example |
| 8 | ○ | ○ | ○ | ◎ | ○ | ○ | Example |
| 9 | X | X | Δ | ◎ | X | ○ | Comparative example |
| 10 | ○ | ◎ | ◎ | ◎ | ○ | Δ | Example |
| 11 | ○ | ◎ | ◎ | ◎ | ○ | ○ | Example |

ing layer of Recording sheet 13. A pore volume with a pore radius of 100 nm or less of the obtained toner receiving layer was 0.9 mL/g.

[Uppermost Layer Coating Solution 2]

| | |
|---|---|
| Cationic colloidal silica sol (as a silica solid content) (available from Nissan Chemical Co., Ltd., ST-AK-L, average particle diameter: 40 to 45 nm) | 100 parts |
| Polyvinyl alcohol (saponification degree: 88%, average polymerization degree: 3500) | 8 parts |
| Surfactant (Nonionic; NIKKOL BT-9, available from Nihon Surfactant Kogyo K.K.) | 0.2 part |
| Boric acid | 1 part |

The mixture was adjusted with water so as to a colloidal silica solid concentration of 10%.

<Preparation of Recording Sheet 14>

In the same manner as in Recording sheet 12, Recording sheet 14 was prepared except for changing the uppermost layer coating solution 1 of the above-mentioned Recording sheet 12 to the uppermost layer coating solution 3 mentioned below. A pore volume with a pore radius of 100 nm or less of the obtained toner receiving layer was 1.0 mL/g.

[Uppermost Layer Coating Solution 3]

To water was added Quartron PL-3L to prepare a liquid with a solid content concentration of 5% by weight, and after the mixture was stirred at a temperature of 80° C. for 1 hour, it was cooled to room temperature and adjusted with water so that the solid content concentration became 0.6% by weight. When the dried material of the coating solution was observed by an electron microscope, an average primary particle size of the colloidal silica was 35 nm.

<Evaluation>

With regard to Recording sheets 12 to 14 and Recording sheet 1, toner fixability and transferability were evaluated in the same manner as in Recording sheets 1 to 11. Moreover, continuous printability was further evaluated according to the following mentioned evaluation method and the results are also shown in Table 2.

[Continuous Printability]

"HP Indigo Press 5500" manufactured by HEWLETTE PACKARD was used as a printer for wet electrophotography which transfers an image from a heated blanket roll to a recording sheet, and evaluation of occurrence state of ghost after continuous printing was carried out. At the time of continuous printing, an image in which a white paper portion (a non-image portion), and gray and black solid portions were placed side by side was printed, thereafter a solid image with whole gray was printed to evaluate occurrence of ghost or not.

○: Substantially no ghost can be admitted.

Δ: Slight ghost can be admitted.

X: Ghost is remarkable.

As is clear from the above-mentioned results, by making the toner receiving layer of the present invention at least two layers comprising a layer containing inorganic fine particles and an uppermost layer containing cationic colloidal silica provided thereon, the resulting recording sheet has excellent toner fixability and transferability, and occurrence of ghost in continuous printing can be restrained.

<Preparation of Recording Sheet 15>

[Preparation of Toner Receiving Layer]

On the subbing layer of Substrate 1 which is the same as that used in Recording sheet 1 was coated the toner receiving layer coating solution 10 having the following composition by using a slide bead coating device so that a dry coated amount became 10 g/m$^2$. After coating, it was cooled at 10° C. for 20 seconds, and then, hot air of 30 to 55° C. was blown to the same to carry out drying. A pore volume with a pore radius of 100 nm or less of the obtained toner receiving layer was 0.7 mL/g.

[Preparation of Pearl Gloss Pigment Dispersion 1]

To water was added pearl gloss pigment (MM-100R available from NIHONKOKEN Co., Ltd.) to prepare a provisional dispersion, and then, the mixture was subjected to propeller stirring at 700 rpm for 5 minutes to prepare Pearl gloss pigment dispersion 1 with a solid content concentration of 25%.

[Toner Receiving Layer Coating Solution 10]

| | |
|---|---|
| Inorganic fine particles dispersion 1 (as a solid content of the inorganic fine particles) | 100 parts |
| Pearl gloss pigment dispersion 1 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 16>

In the same manner as in Recording sheet 15, Recording sheet 16 was prepared except for changing the toner receiving layer coating solution 10 of Recording sheet 15 to the toner receiving layer coating solution 11 having the following composition. A pore volume with a pore radius of 100 nm or less of the obtained toner receiving layer was 0.7 mL/g.

[Preparation of Pearl Gloss Pigment Dispersion 2]

To water was added pearl gloss pigment (ME-100R, available from NIHONKOKEN Co., Ltd.) to prepare a provisional dispersion, then, the mixture was stirred at 700 rpm for 5 minutes by propeller stirring to obtain a pearl gloss pigment dispersion 2 having a solid content concentration of 25%.

[Toner Receiving Layer Coating Solution 11]

| | |
|---|---|
| Inorganic fine particles dispersion 1 (as a solid content of the inorganic fine particles) | 100 parts |

TABLE 2

| Recording sheet No. | Tape peeling test: Immediately after | After 1 hour | After 4 hours | After 1 day | Transferability | Continuous printability | Remarks |
|---|---|---|---|---|---|---|---|
| 12 | ○ | ◎ | ◎ | ◎ | ○ | ○ | Example |
| 13 | ○ | ◎ | ◎ | ◎ | ○ | ○ | Example |
| 14 | Δ | Δ | Δ | Δ | ○ | ○ | Example |
| 1 | ○ | ◎ | ◎ | ◎ | ○ | X | Example |

-continued

| | |
|---|---|
| Pearl gloss pigment dispersion 2 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 17>

In the same manner as in Recording sheet 15, Recording sheet 17 was prepared except for changing the toner receiving layer coating solution 10 of Recording sheet 15 to the toner receiving layer coating solution 12 having the following composition. A pore volume with a pore radius of 100 nm or less of the obtained toner receiving layer was 0.7 mL/g.

[Preparation of Pearl Gloss Pigment Dispersion 3]

To water was added pearl gloss pigment (Iriodin 123 Bright Lustre Satin available from Merck Co., & Inc.) to prepare a provisional dispersion, then, the mixture was subjected to propeller stirring at 700 rpm for 5 minutes to prepare Pearl gloss pigment dispersion 3 with a solid content concentration of 25%.

[Toner Receiving Layer Coating Solution 12]

| | |
|---|---|
| Inorganic fine particles dispersion 1 (as a solid content of the inorganic fine particles) | 100 parts |
| Pearl gloss pigment dispersion 3 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 18>

In the same manner as in Recording sheet 15, Recording sheet 18 was prepared except for changing the toner receiving layer coating solution 10 of Recording sheet 15 to the toner receiving layer coating solution 13 having the following composition. A pore volume with a pore radius of 100 nm or less of the obtained toner receiving layer was 0.6 mL/g.

[Toner Receiving Layer Coating Solution 13]

| | |
|---|---|
| Inorganic fine particles dispersion 1 (as a solid content of the inorganic fine particles) | 100 parts |
| Pearl gloss pigment dispersion 1 (as a solid content of the pearl gloss pigment) | 35 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 19>

In the same manner as in Recording sheet 15, Recording sheet 19 was prepared except for changing the toner receiving layer coating solution 10 of Recording sheet 15 to the toner receiving layer coating solution 14 having the following composition. A pore volume with a pore radius of 100 nm or less of the obtained toner receiving layer was 0.5 mL/g.

[Toner Receiving Layer Coating Solution 14]

| | |
|---|---|
| Inorganic fine particles dispersion 1 (as a solid content of the inorganic fine particles) | 100 parts |
| Pearl gloss pigment dispersion 1 (as a solid content of the pearl gloss pigment) | 60 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 20>

In the same manner as in Recording sheet 15, Recording sheet 20 was prepared except for changing the toner receiving layer coating solution 10 of Recording sheet 15 to the toner receiving layer coating solution 15 having the following composition. A pore volume with a pore radius of 100 nm or less of the obtained toner receiving layer was 0.7 mL/g.

[Toner Receiving Layer Coating Solution 15]

| | |
|---|---|
| Inorganic fine particles dispersion 1 (as a solid content of the inorganic fine particles) | 100 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 21>

In the same manner as in Recording sheet 15, Recording sheet 21 was prepared except for changing the toner receiving layer coating solution 10 of Recording sheet 15 to the toner receiving layer coating solution 16 having the following composition. A pore volume with a pore radius of 100 nm or less of the obtained toner receiving layer was 0.8 mL/g.

[Toner Receiving Layer Coating Solution 16]

| | |
|---|---|
| Inorganic fine particles dispersion 2 (as a solid content of the inorganic fine particles) | 100 parts |
| Pearl gloss pigment dispersion 1 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 22>

In the same manner as in Recording sheet 15, Recording sheet 22 was prepared except for changing the toner receiving layer coating solution 10 of Recording sheet 15 to the toner receiving layer coating solution 17 having the following composition. A pore volume with a pore radius of 100 nm or less of the obtained toner receiving layer was 0.8 mL/g.

[Toner Receiving Layer Coating Solution 17]

| | |
|---|---|
| Inorganic fine particles dispersion 2 (as a solid content of the inorganic fine particles) | 100 parts |
| Pearl gloss pigment dispersion 2 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 23>

In the same manner as in Recording sheet 15, Recording sheet 23 was prepared except for changing the toner receiving layer coating solution 10 of Recording sheet 15 to the toner receiving layer coating solution 18 having the following composition. A pore volume with a pore radius of 100 nm or less of the obtained toner receiving layer was 0.8 mL/g.

[Toner Receiving Layer Coating Solution 18]

| | |
|---|---|
| Inorganic fine particles dispersion 2 (as a solid content of the inorganic fine particles) | 100 parts |
| Pearl gloss pigment dispersion 3 (as a solid content of the pearl gloss pigment) | 20 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 24>

In the same manner as in Recording sheet 15, Recording sheet 24 was prepared except for changing the toner receiving layer coating solution 10 of Recording sheet 15 to the toner receiving layer coating solution 19 having the following composition. A pore volume with a pore radius of 100 nm or less of the obtained toner receiving layer was 0.8 mL/g.

[Toner Receiving Layer Coating Solution 19]

| | |
|---|---|
| Inorganic fine particles dispersion 2 (as a solid content of the inorganic fine particles) | 100 parts |
| Polyvinyl alcohol (saponification degree: 88%, average polymerization degree: 3500) | 40 parts |
| Boric acid | 6 parts |

The mixture was adjusted with water so as to have a solid concentration of 12%.

<Preparation of Recording Sheet 25>

In the same manner as in Recording sheet 15, Recording sheet 25 was prepared except for changing the toner receiving layer coating solution 10 of Recording sheet 15 to the toner receiving layer coating solution 20 having the following composition. A pore volume with a pore radius of 100 nm or less of the obtained toner receiving layer was 0.8 mL/g.

[Toner Receiving Layer Coating Solution 20]

| | |
|---|---|
| Inorganic fine particles dispersion 3 (as a solid content of the inorganic fine particles) | 100 parts |
| Pearl gloss pigment dispersion 1 (as a solid content of the pearl gloss pigment) | 20 parts |
| Polyvinyl alcohol (saponification degree: 88%, average polymerization degree: 3500) | 20 parts |
| Boric acid | 1 part |

The mixture was adjusted with water so as to have a solid concentration of 12%.

<Preparation of Recording Sheet 26>

In the same manner as in Recording sheet 15, Recording sheet 26 was prepared except for changing the toner receiving layer coating solution 10 of Recording sheet 15 to the toner receiving layer coating solution 21 having the following composition. A pore volume with a pore radius of 100 nm or less of the obtained toner receiving layer was 0.8 mL/g.

[Toner Receiving Layer Coating Solution 21]

| | |
|---|---|
| Inorganic fine particles dispersion 3 (as a solid content of the inorganic fine particles) | 100 parts |
| Pearl gloss pigment dispersion 2 (as a solid content of the pearl gloss pigment) | 20 parts |
| Polyvinyl alcohol (saponification degree: 88%, average polymerization degree: 3500) | 20 parts |
| Boric acid | 1 part |

The mixture was adjusted with water so as to have a solid concentration of 12%.

<Preparation of Recording Sheet 27>

In the same manner as in Recording sheet 15, Recording sheet 27 was prepared except for changing the toner receiving layer coating solution 10 of Recording sheet 15 to the toner receiving layer coating solution 22 having the following composition. A pore volume with a pore radius of 100 nm or less of the obtained toner receiving layer was 0.8 mL/g.

[Toner Receiving Layer Coating Solution 22]

| | |
|---|---|
| Inorganic fine particles dispersion 3 (as a solid content of the inorganic fine particles) | 100 parts |
| Pearl gloss pigment dispersion 3 (as a solid content of the pearl gloss pigment) | 20 parts |
| Polyvinyl alcohol (saponification degree: 88%, average polymerization degree: 3500) | 20 parts |
| Boric acid | 1 part |

The mixture was adjusted with water so as to have a solid concentration of 12%.

<Preparation of Recording Sheet 28>

In the same manner as in Recording sheet 15, Recording sheet 28 was prepared except for changing the toner receiving layer coating solution 10 of Recording sheet 15 to the toner receiving layer coating solution 23 having the following composition. A pore volume with a pore radius of 100 nm or less of the obtained toner receiving layer was 0.8 mL/g.

[Toner Receiving Layer Coating Solution 23]

| | |
|---|---|
| Inorganic fine particles dispersion 3 (as a solid content of the inorganic fine particles) | 100 parts |
| Polyvinyl alcohol (saponification degree: 88%, average polymerization degree: 3500) | 20 parts |
| Boric acid | 1 part |

The mixture was adjusted with water so as to have a solid concentration of 12%.

<Evaluation>

With regard to Recording sheets 15 to 28, they were evaluated by the following mentioned evaluation methods and the results are shown in Table 3. Incidentally, Recording sheets 15 to 28 are all have excellent toner fixability and transferability, and Recording sheets 15 to 28 before transferring an image each had an extremely high glossiness like a silver salt photographic printing paper.

[Gloss Unevenness Evaluation 1]

Image evaluation was carried out by using HP Indigo Press 5500. As a printed image, with regard to each color of cyan, magenta, yellow, red, blue, green and black, by using respective rectangular patterns which became respective concentrations of 10%, 20%, 40%, 60%, 80%, 100% with regard to the respect colors, an image was printed on the recording sheet. Between rectangular patterns of the respective concentrations, a white portion was remained, and 40% of the whole area was not printed to remain a white paper portion. By using the printed material, gloss unevenness was evaluated by the following criteria.

◎: Gloss unevenness between white paper portion and image portion is extremely little and uniform.

○: Gloss unevenness between white paper portion and image portion is a little, and relatively uniform.

Δ: Gloss unevenness between white paper portion and image portion exists.

X: Gloss unevenness between white paper portion and image portion is large and remarkable.

[Gloss Unevenness Evaluation 2]

By using HP Indigo Press 5500, and using a personal face photograph as a printed image, the image was printed on a recording sheet. As the face photograph used for the image for evaluation, black-haired female was employed. By using the printed material, gloss unevenness was evaluated by the following criteria.

◎: Gloss unevenness between hair portion and skin portion is extremely little and image quality looks like a silver salt photography.

○: Gloss unevenness between hair portion and skin portion is a little, and image quality looks like near to a silver salt photography.

Δ: Gloss unevenness between hair portion and skin portion exists, and it is inferior to that of a silver salt photography.

X: Gloss unevenness between hair portion and skin portion is large and there is a sense of incongruity.

TABLE 3

| Recording sheet No. | Gloss unevenness evaluation 1 | Gloss unevenness evaluation 2 | Remarks |
|---|---|---|---|
| 15 | ◎ | ◎ | Example |
| 16 | ◎ | ◎ | Example |
| 17 | ◎ | ◎ | Example |
| 18 | ◎ | ◎ | Example |
| 19 | ◎ | ◎ | Example |
| 20 | Δ | Δ | Example |
| 21 | ◎ | ○ | Example |
| 22 | ◎ | ○ | Example |
| 23 | ◎ | ○ | Example |
| 24 | Δ | Δ | Example |
| 25 | ○ | ◎ | Example |
| 26 | ○ | ◎ | Example |
| 27 | ○ | ◎ | Example |
| 28 | X | Δ | Example |

As is clear from the above-mentioned results, by making the toner receiving layer of the present invention further containing pearl gloss pigment, the resulting recording sheet has excellent toner fixability and transferability, and gloss unevenness between the image portion and the non-image portion is improved so that it is preferred.

<Preparation of Recording Sheet 29>

[Preparation of Toner Receiving Layer]

On the subbing layer of Substrate 1 which is the same as that used in Recording sheet 1 was coated the toner receiving layer coating solution 24 having the following composition by using a slide bead coating device so that a dry coated amount became 25 g/m$^2$. After coating, hot air of 60° C. was blown to the coated material to dry the same. A pore volume with a pore radius of 100 nm or less of the obtained toner receiving layer was 1.0 mL/g.

[Toner Receiving Layer Coating Solution 24]

| | |
|---|---|
| Inorganic fine particles dispersion 1 (as a solid content of the inorganic fine particles) | 100 parts |
| Acetacetyl-modified polyvinyl alcohol (Acetoacetylation degree: 3%, saponification degree: 98%, average polymerization degree: 2350) | 22 parts |
| Adipic acid dihydrazide | 2 parts |

<Preparation of Recording Sheet 30>

In the same manner as in Recording sheet 29, Recording sheet 30 was prepared except for changing the toner receiving layer coating solution 24 of the above-mentioned Recording sheet 29 to the toner receiving layer coating solution 25 having the following composition. A pore volume with a pore radius of 100 nm or less of the obtained toner receiving layer was 1.2 mL/g.

[Toner Receiving Layer Coating Solution 25]

| | |
|---|---|
| Inorganic fine particles dispersion 2 (as a solid content of the inorganic fine particles) | 100 parts |
| Acetacetyl-modified polyvinyl alcohol (Acetoacetylation degree: 3%, saponification degree: 98%, average polymerization degree: 2350) | 22 parts |
| Adipic acid dihydrazide | 2 parts |

<Preparation of Recording Sheet 31>

In the same manner as in Recording sheet 29, Recording sheet 31 was prepared except for changing the toner receiving layer coating solution 24 of the above-mentioned Recording sheet 29 to the toner receiving layer coating solution 26 having the following composition. A pore volume with a pore radius of 100 nm or less of the obtained toner receiving layer was 0.9 mL/g.

[Toner Receiving Layer Coating Solution 26]

| | |
|---|---|
| Inorganic fine particles dispersion 1 (as a solid content of the inorganic fine particles) | 100 parts |
| Diacetone acrylamide-modified polyvinyl alcohol (Diacetone acrylamide-modified degree: 5%, saponification degree: 98%, average polymerization degree: 1700) | 25 parts |
| Adipic acid dihydrazide | 2 parts |

<Preparation of Recording Sheet 32>

In the same manner as in Recording sheet 29, Recording sheet 32 was prepared except for changing the toner receiving layer coating solution 24 of the above-mentioned Recording sheet 29 to the toner receiving layer coating solution 27 having the following composition. A pore volume with a pore radius of 100 nm or less of the obtained toner receiving layer was 1.0 mL/g.

[Toner Receiving Layer Coating Solution 27]

| | |
|---|---|
| Inorganic fine particles dispersion 1 (as a solid content of the inorganic fine particles) | 100 parts |
| Acetacetyl-modified polyvinyl alcohol | 22 parts |

(Acetoacetylation degree: 3%, saponification degree: 98%, average polymerization degree: 2350)

<Evaluation>

With regard to Recording sheets 29 to 32 and Recording sheet 1, toner fixability and transferability were evaluated in the same manner as in Recording sheets 1 to 11. Further, crack by folding was also measured according to the following mentioned evaluation method, and the results are also shown in Table 4.

[Crack by Folding]

The recording sheet was wound around a cylinder having a diameter of 1 inch so that the recording surface became outside, and whether crack is generated or not at the surface is observed and evaluated according to the following criteria. Incidentally, the recording sheet having cracks at the surface thereof before testing was not evaluated (in the table, it is shown by "—").

○: No crack occurred.

X: Crack occurred.

TABLE 4

| Recording sheet No. | Tape peeling test: Immediately after | After 1 hour | After 4 hours | After 1 day | Transferability | Crack by folding | Remarks |
|---|---|---|---|---|---|---|---|
| 29 | ○ | ◎ | ◎ | ◎ | ○ | ○ | Example |
| 30 | ○ | ◎ | ◎ | ◎ | ○ | ○ | Example |
| 31 | ○ | ◎ | ◎ | ◎ | ○ | ○ | Example |
| 32 | ○ | ○ | ○ | ○ | Δ | — | Example |
| 1 | ○ | ◎ | ◎ | ◎ | ○ | X | Example |

As is clear from the above-mentioned results, by further adding a modified polyvinyl alcohol having a keto group and a cross-linking agent thereof to the toner receiving layer of the present invention, excellent toner fixability and transferability as well as excellent resistance to crack by folding can be obtained so that such a constitution is preferred.

The present application is based on, and claims priority from Japanese Patent Applications No. 2010-154730 filed Jul. 7, 2010, No. 2010-272683 filed Dec. 7, 2010, No. 2011-014743 filed Jan. 27, 2011, No. 2011-015052 filed Jan. 27, 2011 and No. 2011-038735 filed Feb. 24, 2011, the disclosures of which are hereby incorporated by reference herein in their entireties.

The invention claimed is:

1. A method of printing by wet electrophotography, which method comprises providing a recording sheet comprising a substrate with a toner receiving layer thereon, said toner receiving layer containing inorganic fine particles and having a pore volume with a pore radius of 100 nm or less measured by a nitrogen adsorption method of 0.3 mL/g or more on said substrate, and transferring an image from a heated blanket roll onto said recording sheet.

2. The method of printing by wet electrophotography of claim 1, wherein said substrate is a non-water-absorbable paper at least one surface of which is coated with a resin.

3. The method of printing by wet electrophotography of claim 1, wherein a content of the inorganic fine particles in said toner receiving layer is 50% by weight or more based on the whole solid content of the toner receiving layer.

4. The method of printing by wet electrophotography of claim 3, wherein a content of the inorganic fine particles in said toner receiving layer is 70% by weight or more based on the whole solid content of the toner receiving layer.

5. The method of printing by wet electrophotography of claim 1, wherein an average secondary particle diameter of said inorganic fine particles is 500 nm or less.

6. The method of printing by wet electrophotography of claim 1, wherein said pore volume is 0.7 mL/g or more.

7. The method of printing by wet electrophotography of claim 6, wherein said pore volume is 0.9 mL/g or more.

8. The method of printing by wet electrophotography of claim 1, wherein said toner receiving layer comprises at least two layers wherein an uppermost layer containing cationic colloidal silica is provided on a layer containing inorganic fine particles.

9. The method of printing by wet electrophotography of claim 1, wherein said toner receiving layer contains a pearl gloss pigment.

10. The method of printing by wet electrophotography of claim 1, wherein said toner receiving layer contains a modified polyvinyl alcohol having a keto group and a cross-linking agent thereof.

11. The method of printing by wet electrophotography of claim 1, wherein a dry coated amount of said toner receiving layer is 0.1 to 2 g/m$^2$, and an arithmetical mean roughness Ra regulated by JIS B0601-1982 of the toner receptive layer-coated surface of said substrate is 0.5 μm or more.

12. The method of printing by wet electrophotography of claim 1, wherein the image is transferred from the heated blanket roll onto the recording sheet via an E-PRINT 1000 digital offset color printing press.

13. The method of printing by wet electrophotography of claim 1, wherein the image is transferred from the heated blanket roll onto the recording sheet via HP Indigo Press 5500.

14. A method of manufacturing a substrate which avoids the occurrence of ghost in continuous printing by wet electrophotography, which method comprises providing a recording sheet comprising a substrate, providing a toner receiving layer containing inorganic fine particles and having a pore volume with a pore radius of 100 nm or less measured by a nitrogen adsorption method of 0.3 mL/g or more on said substrate, wherein said toner receiving layer comprises at least two layers wherein an uppermost layer containing cationic colloidal silica is provided on the layer containing inorganic fine particles, and transferring an image from a heated blanket roll onto said recording sheet.

15. A method of avoiding gloss unevenness between an image portion and a non-image portion in continuous printing by wet electrophotography, which method comprises providing a recording sheet comprising a substrate, providing a toner receiving layer containing pearl gloss pigment and inorganic fine particles and having a pore volume with a pore radius of 100 nm or less measured by a nitrogen adsorption method of 0.3 mL/g or more on said substrate, and transferring an image from a heated blanket roll onto said recording sheet.

16. A method of imparting resistance to crack by folding in continuous printing by wet electrophotography, which method comprises providing a recording sheet comprising a substrate, providing a toner receiving layer containing a modified polyvinyl alcohol having a keto group and a cross-linking agent thereof as well as inorganic fine particles and having a pore volume with a pore radius of 100 nm or less measured by a nitrogen adsorption method of 0.3 mL/g or more on said substrate, and transferring an image from a heated blanket roll onto said recording sheet.

* * * * *